US005269279A

United States Patent [19]

Mukai et al.

[11] Patent Number: 5,269,279

[45] Date of Patent: Dec. 14, 1993

[54] EVAPORATING FUEL CONTROL DEVICE FOR VEHICLES

[75] Inventors: Takeshi Mukai; Harumi Suzuki; Hitoshi Nakashima, all of Shizuoka, Japan

[73] Assignee: Suzuki Motor Corporation, Shizuoka, Japan

[21] Appl. No.: 996,957

[22] Filed: Dec. 23, 1992

[30] Foreign Application Priority Data

Dec. 28, 1991 [JP] Japan ..... 3-360640

[51] Int. Cl.[5] ..... F02M 37/04

[52] U.S. Cl. ..... 123/520; 123/516

[58] Field of Search ..... 123/520, 521, 519, 518, 123/516, 557, 558, 559

[56] References Cited

U.S. PATENT DOCUMENTS

| | | | |
|---|---|---|---|
| 4,318,383 | 3/1982 | Iratani | 123/520 |
| 4,867,126 | 9/1989 | Yonekawa | 123/520 |
| 4,945,885 | 8/1990 | Gonze | 123/518 |
| 5,020,503 | 6/1991 | Kanasashi | 123/520 |
| 5,085,194 | 2/1992 | Kuroda | 123/520 |
| 5,143,035 | 9/1992 | Kayanuma | 123/520 |
| 5,143,040 | 9/1992 | Okawa | 123/520 |

FOREIGN PATENT DOCUMENTS

| | | | |
|---|---|---|---|
| 62-17354 | 1/1987 | Japan . | |
| 0017354 | 1/1987 | Japan | 123/520 |
| 62-20669 | 1/1987 | Japan . | |
| 62-243957 | 10/1987 | Japan . | |

*Primary Examiner*—Carl S. Miller

*Attorney, Agent, or Firm*—Flynn, Thiel, Boutell & Tanis

[57] ABSTRACT

Hydrocarbons (HC) absorbed in a canister are purged fully by correcting and controlling a duty percent from a base map for increasing a rate of purging evaporating fuel from the canister when one or more of the conditions indicative of an increase of evaporating fuel are detected so that degradation of the canister's performance can be prevented, release of hydrocarbons (HC) from the canister to atmosphere can be prevented by eliminating inadequate purge, and durability of the canister can be improved.

2 Claims, 4 Drawing Sheets

FIG. 8

Pmap2 (duty %)

| | | | | | |
|---|---|---|---|---|---|
| | | | | | |
| | 30+α | 40+α | 50+α | 60+α | |
| | 20+α | 30+α | 40+α | 50+α | |
| | 10+α | 20+α | 30+α | 40+α | |
| | | | | | |

LARGER ↑ LOAD ↓ SMALLER

ENGINE SPEED Ne →

FIG. 9

Pmap (duty %)

| | | | | | |
|---|---|---|---|---|---|
| | | | | | |
| | 30 | 40 | 50 | 60 | |
| | 20 | 30 | 40 | 50 | |
| | 10 | 20 | 30 | 40 | |
| | | | | | |

LARGER ↑ LOAD ↓ SMALLER

ENGINE SPEED Ne →

EVAPORATING FUEL CONTROL DEVICE FOR VEHICLES

FIELD OF THE INVENTION

The present invention relates to an evaporating fuel control device for a vehicle, and more particularly relates to an evaporating fuel control device with a canister arranged in an air path communicating inside of a fuel tank to an intake air path in an air intake system of a combustion engine wherein the rate of purging of evaporating fuel from the canister is controlled according to a duty percent determined from a base map stored in a control unit.

BACKGROUND OF THE INVENTION

Evaporating or evaporated fuel leaking to atmosphere from a fuel tank or a float chamber in a carburetor contains considerable hydrocarbons and is one of the causes for air pollution. Also, it is a cause for fuel loss. Various types of technology have been introduced to prevent evaporating fuel leakage to the atmosphere. One of the representative technologies for that purpose involves absorbing and storing evaporating fuel in a fuel tank in a canister, which contains absorbent such as activated carbon, when the engine is not operative and then purging and feeding the evaporating fuel absorbed by and stored in the canister to the engine when it is running.

This type of evaporating fuel control device for vehicles is disclosed, for instance, in Japanese Patent Laid Open Publication 17354/1987. The fuel vapor discharge blocking apparatus disclosed in this patent publication has a canister arranged to collect evaporating fuel generated in a fuel tank, a first path means having a relatively large path area and a second path means having a relatively small path area, each connected in parallel to a suction system of an engine. Valve means selectively communicates one of the first and second path means. Temperature detecting means detects fuel temperature and communicates the suction system of the engine to the first path means when temperature of the fuel is higher than a previously specified value, to the second path means when temperature of the fuel is lower than a previously specified value, and to the first path means only for a specified period when the temperature of the fuel detected when the engine is restarted is lower than temperature of the fuel detected when the engine is shut off and the temperature detected and remembered by the temperature detecting section is lower than the previously specified value.

Also, another example of an evaporating fuel control device is disclosed in Japanese Patent Laid Open Publication 20669/1987. The disclosed fuel evaporating vapor discharge blocking apparatus has a running state detecting means for detecting the running state of a combustion engine, an evaporating gas path to introduce a fuel evaporating gas into a fuel tank, and a variable control means for flexibly controlling a path area of the evaporating gas path according to the running state of the engine, and controlling the path area of the evaporating gas path according to a fuel feed rate to the combustion engine or a relative number of rotations previously set for the idling state.

Another example of an evaporating fuel control device is disclosed in Japanese Patent Laid Open Publication No. 243957/1987. The disclosed method of controlling fuel feed when a combustion engine is started is based on a system having an electro-magnetic valve arranged to open or close a communicating path which communicates a canister to an intake air path in the downstream of a throttle valve. The system prevents leaning of mixed air fed to the engine by determining whether the engine is started under high fuel temperature or not and opening the electro-magnetic valve to discharge evaporating fuel from the canister to the intake air path.

In conventional types of evaporating fuel control devices, as shown in FIG. 9, a duty percent is calculated, for instance, from a base map comprising an engine speed, Ne, and a load. A purge control valve arranged in an air path between a canister and an intake air path is opened or closed according to the duty percent for controlling a rate of purging evaporating fuel.

In the evaporating fuel control devices as described above, however, a quantity of hydrocarbons (HC) generated from a fuel tank increases, for instance, when an engine is run under high temperature in summer.

As a result, hydrocarbons (HC) absorbed in the canister cannot be purged fully because the rate of purging evaporating fuel is adjusted to the same level as that under the normal temperature, and performance of the canister goes down. This situation is disadvantageous for practical operation, and also a large quantity of hydrocarbons (HC) may be released from the canister to atmosphere.

An object of the present invention is to solve the problems described above.

SUMMARY OF THE INVENTION

The present invention provides an evaporating fuel control device with a canister arranged in an air path communicating a fuel tank to an intake air path in an air intake system of a combustion engine so as to absorb and store evaporating fuel generated in the aforesaid fuel tank in the canister when the combustion engine is shut off and to purge and feed the absorbed and stored evaporating fuel to the intake air path when the combustion engine is running; characterized in that the control device includes a detecting means to detect one or more conditions indicative of an increase of the evaporating fuel and control means operable in response to the detecting means to correct and control a duty percent from a base map to increase a rate of purging the evaporating fuel from the canister when a signal from the detecting means indicates an increase of evaporating fuel.

The evaporating fuel control device according to the present invention corrects and controls a duty percent from a base map to increase a rate of purging evaporating fuel from the canister when the preset conditions indicative of an increase of evaporating fuel are satisfied, fully purges hydrocarbons (HC) absorbed in the canister to prevent performance of the canister from dropping, prevents hydrocarbons (HC) from being released from the canister to atmosphere due to inadequate purge, and in addition improves durability of the canister.

BRIEF DESCRIPTION OF THE DRAWINGS

Detailed description is made hereinafter for preferred embodiments of the present invention with reference to the related drawings.

FIG. 8 is a diagram of a correction map comprising engine speed versus a load.

FIG. 9 is a block diagram of a base map comprising engine speed versus a load which shows the prior art in the field of the present invention.

DETAILED DESCRIPTION

Figure 1:
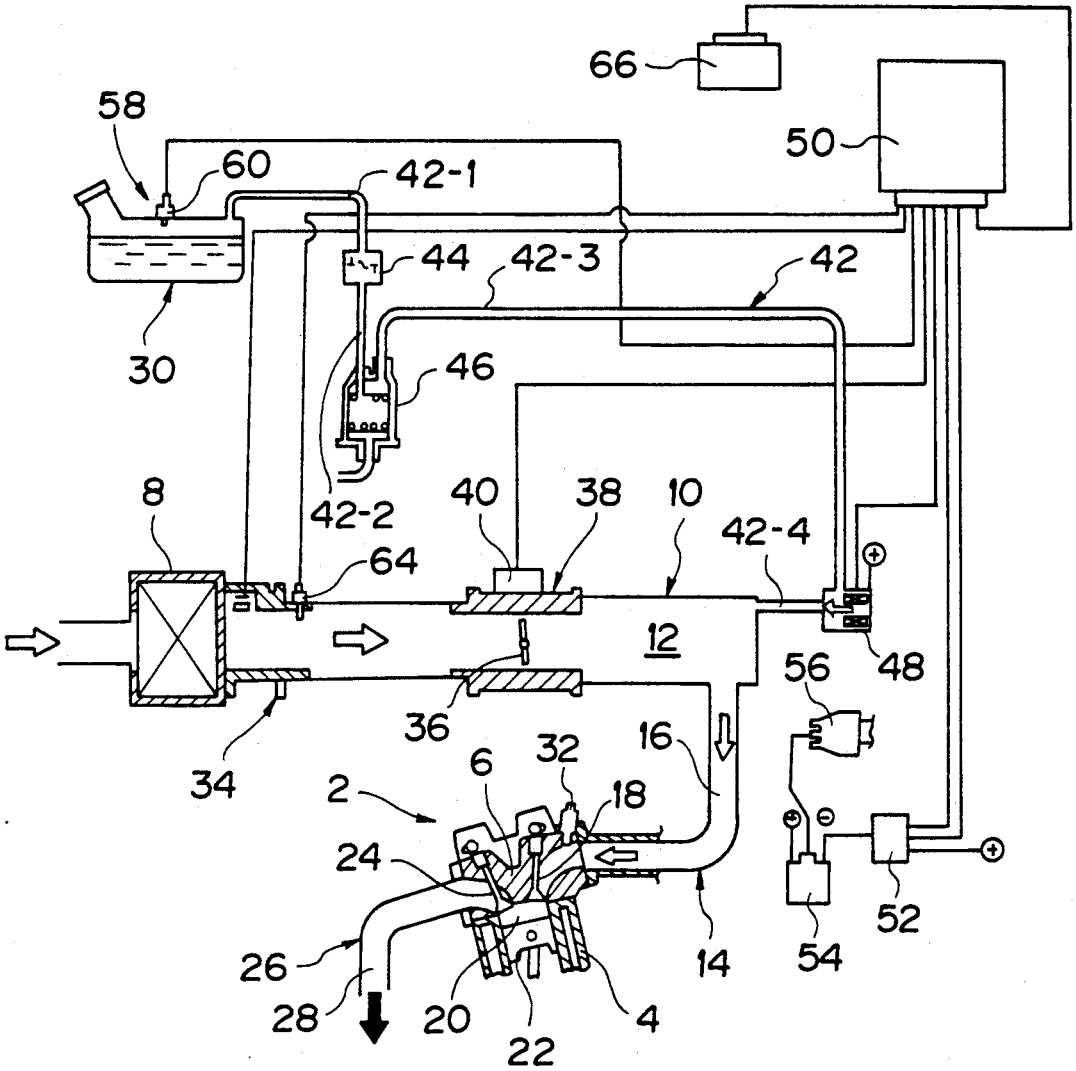
FIG. 1 is a general block diagram showing an evaporating fuel control device for vehicles according to a first embodiment of the present invention.

FIGS. 1 to 6 show a first embodiment of the present invention. In FIG. 1, numeral 2 indicates a combustion engine for a vehicle not shown in the figure, numeral 4 indicates a cylinder block, numeral 6 indicates a cylinder head, numeral 8 indicates an air cleaner, numeral 10 indicates a suction pipe, numeral 12 indicates an intake air path, numeral 14 indicates an inlet manifold, numeral 16 indicates an intake air path in the manifold, numeral 18 indicates an intake valve, numeral 20 indicates a combustion chamber, numeral 22 indicates a piston, numeral 24 indicates an exhaust valve, numeral 26 indicates an exhaust manifold, numeral 28 indicates an exhaust air path in the exhaust manifold, and numeral 30 indicates a fuel tank. The intake manifold 14 has a fuel injection valve 32 which injects fuel to the combustion chamber 20.

In the suction pipe 10 downstream of the aforesaid air cleaner 8 is arranged an air flow meter 34 which measures an intake rate. Also in the suction pipe 10 is arranged a throttle body 38 having an intake air throttle valve 36. In this throttle body 38 is arranged a throttle sensor 40 having an idle switch not shown in the figure to detect open/closed state of the intake air throttle valve 36 as well as to detect idling.

To guide evaporating fuel generated in the aforesaid fuel tank 30, an air path 42 is provided. One end of air path 42 is communicated to the top of the fuel tank 30, and the other end of air path 42 is communicated to the intake air path 12.

Along this air path 42 are arranged a check valve 44, a canister 46, and a purge control valve 48 successively in this order from the side of the fuel tank 30.

Namely, one end of a first air path 42-1 is communicated to the fuel tank 30, while the other end of this first air path 42-1 is communicated to one side of the check valve 44. One end of a second air path 42-2 is communicated to the other side of the check valve 44. The canister 46 is arranged at the other end of this second air path 42-2. One end of a third air path 42-3 is arranged in this canister 46. The purge control valve 48 is arranged on the other end of this third air path 42-3. An end of a fourth air path 42-4 is arranged in this purge control valve 48, and the other end of this fourth air path 42-4 is communicated to the intake air path 12.

The aforesaid air flow meter 34, the throttle sensor 40, and the purge control valve 48 are communicated to a control means 50, such as a computer control unit.

Also, to this control means 50 is connected an igniter 52. An ignition coil 54 is communicated to the igniter 52, and a distributor 56 is communicated to the ignition coil 54.

Detection means 58 to detect previously specified conditions indicating an increase of evaporating conditions is connected to the aforesaid control means 50. The control means 50 functions to correct and control a duty percent from a base map, Pmap, to increase a rate of purging evaporating fuel from the aforesaid canister 46 when a detection signal from the detecting means 58 satisfies one or more conditions indicative of an increase of evaporating fuel.

Figure 2:
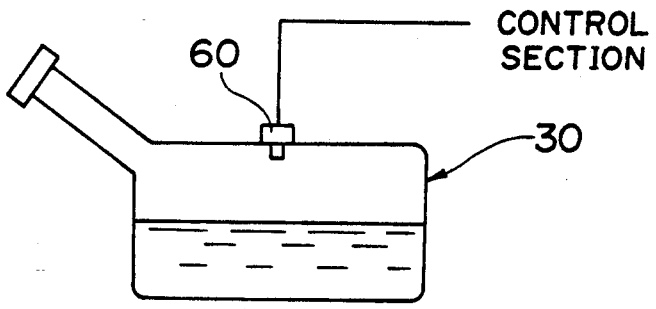
FIG. 2 is a general block diagram of a temperature sensor for detecting temperature of gas in a fuel tank.
Figure 3:
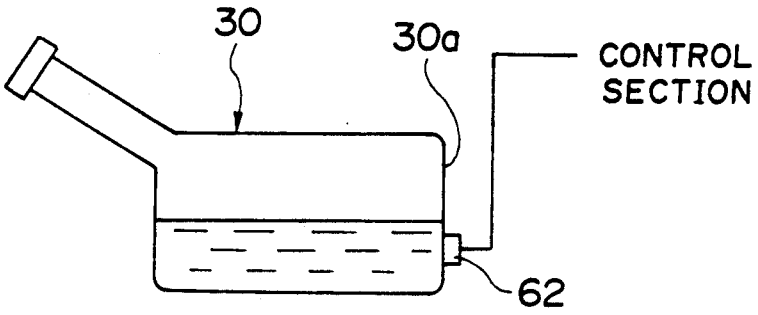
FIG. 3 is a general block diagram of a tank wall temperature sensor for detecting temperature of a wall section of a fuel sensor.

To describe in detail, the aforesaid detecting means 58 comprises a temperature sensor 60 for detecting the temperature of gas in the fuel tank 30 as shown in FIG. 2, or a tank wall temperature sensor 62 for detecting the temperature of a wall section 30*a* of the fuel tank 30 as shown in FIG. 3, an intake air temperature sensor 64 for detecting the temperature of intake air, an A/C controller 66 which outputs a signal to the aforesaid control section 50 when an air conditioner (not shown) is turned ON, and the aforesaid throttle sensor 40 having an idle switch (not shown) which outputs a signal to the control means 50 during idling.

Figure 4:
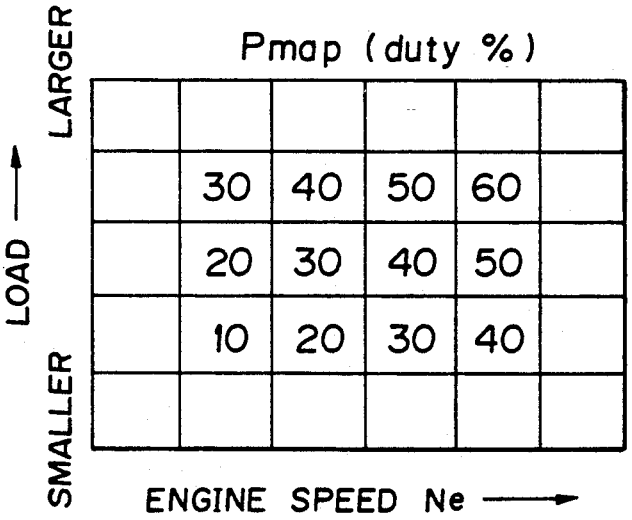
FIG. 4 is a diagram of a base map comprising engine speed versus a load.

The control means 50 includes a base map, Pmap, comprising an engine speed, Ne, versus a load as shown in FIG. 4 stored in computer memory, and controls a rate of purging evaporating fuel from the canister 46 by opening or closing the aforesaid purge valve 48 according to a duty percent from this base map, Pmap.

For instance, a condition indicating an increase of evaporating fuel is preset to any of the following conditions;

1. When the temperature of gas in the fuel tank 30 or the temperature of the tank wall 30*a* changes,
2. When the temperature of intake air changes,
3. When an air conditioner is turned ON, or
4. When idling is started.

Figure 5:
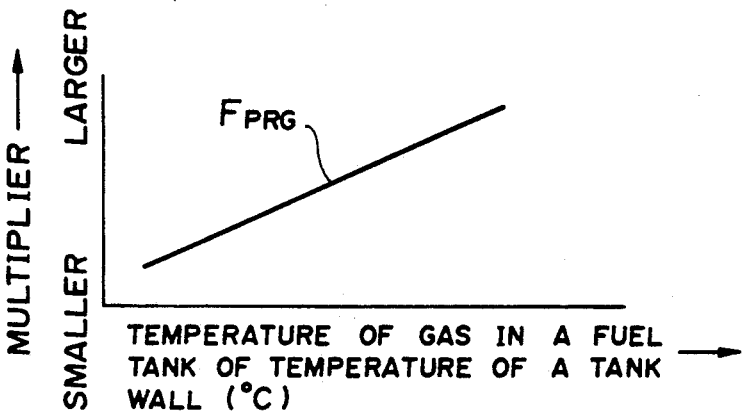
FIG. 5 is a drawing illustrating a relation between temperature of gas in a fuel tank or that of a tank wall and a multiplier, $F_{PRG}$.

Namely, when the temperature of the gas in the fuel tank 30 or temperature of tank wall 30*a* has changed (case 1 above), a multiplier $F_{PRG}$ associated with a change of temperature of gas in a fuel tank or that of a tank wall is obtained by the computer control means 50 from a graph shown in FIG. 5 also stored in computer memory, and a total purge rate $T_{PRG}$ (duty %) is computed through the following equation;

$$T_{PRG}=Pmap\times F_{PRG}$$

Pmap: Purge rate obtained from the base map (duty %)

$F_{PRG}$: Multiplier associated with change of temperature of gas in a fuel tank 30 or that of a tank wall 30*a*.

The purge control valve 48 is opened or closed according to the total purge rate $T_{PRG}$ to control the rate of purging evaporating fuel from canister 46.

Figure 6:
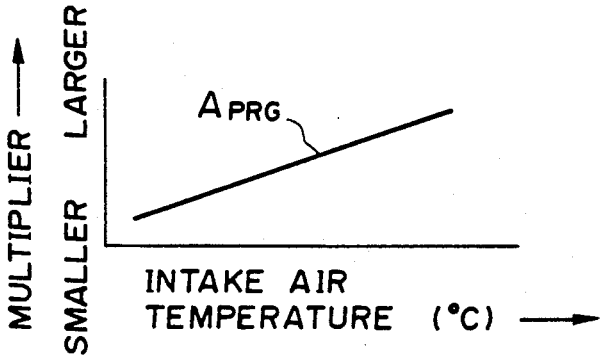
FIG. 6 is a drawing illustrating a relation between temperature of intake air and a multiplier, $A_{PRG}$.

When temperature of intake air is changed (case 2), a multiplier $A_{PRG}$ associated with a change of intake air temperature is obtained from a graph shown in FIG. 6 stored in computer memory. A total purge rate $T_{PRG}$ (duty %) is computed from the following equation;

$$T_{PRG}=Pmap\times A_{PRG}$$

$A_{PRG}$: Multiplier associated with change of temperature of intake air.

The purge control valve 48 is opened or closed according to the total purge rate $T_{PRG}$ to control a rate of purging evaporating fuel from canister 46.

Further, when an air conditioner has been turned ON (case 3), a total purge rate $T_{PRG}$ (duty %) is computed, depending on a correction multiplier preset for ON operation of the air conditioner, through the following equation;

$$T_{PRG}=Pmap\times C_{PRG}$$

$C_{PRG}$: Correction multiplier preset for ON operation of the air conditioner.

The purge control valve 48 is opened or closed according to the total purge rate $T_{PRG}$ to control a rate of purging evaporating fuel from canister 46.

Furthermore, when idling has been started (case 4), a total purge rate $T_{PRG}$ (duty %) is computed, depending on a preset (stored) correction multiplier $I_{PRG}1$ to ON operation of an idle switch (not shown), through the following equation;

$$T_{PRG}=Pmap\times I_{PRG}1$$

$I_{PRG}1$: Correction multiplier preset for ON operation of the idle switch or, a total purge rate $T_{PRG}$ (duty %) is computed, depending on a preset (stored) correction value $I_{PRG}2$, through the following equation;

$$T_{PRG}=Pmap\times I_{PRG}2$$

$I_{PRG}2$: Correction value preset for ON operation of the idle switch.

The purge control valve 48 is opened or closed according to the total purge rage $T_{PRG}$ to control a rate of purging evaporating fuel.

Description is made hereinafter for the aforesaid first (1) embodiment of the invention.

When the aforesaid combustion engine is down (shut off), the control means 50 communicates the first air path 42-1 to the second air path 42-2 via the check valve 44. With this operation, the fuel tank 30 is communicated to the canister 46. Evaporating fuel generated in the fuel tank 30 passes through the check valve 44 via the first air path 42-1, flows from this check valve 44 via the second air path 42-2 into the canister 46, and is absorbed by and stored in absorbent in this canister 46.

When operation of the combustion engine 2 is started, the purge control valve 48 is opened by command of control means 50 to communicate the third air path 42-3 to the fourth air path 42-4 so that evaporating fuel in the canister 46 is purged, the evaporating fuel being fed to the combustion engine 2, as adjusted by the purge control valve 48.

When temperature of gas in a fuel tank or temperature of a tank wall has changed (case 1), a multiplier $F_{PRG}$ associated with a change of temperature of gas in a fuel tank 30 or that of a tank wall 30*a* is obtained by control means 50 from the stored graph shown in FIG. 5, and a total purge rate $T_{PRG}$ (duty %) is computed, depending on the multiplier above, through the following equation;

$$T_{PRG}=Pmap\times F_{PRG}.$$

The purge control valve 48 is opened or closed by the aforesaid control means 50 to adjust a purge rate to the total purge rate $T_{PRG}$.

When temperature of intake air has changed (case 2), a multiplier $A_{PRG}$ associating with change of temperature of intake air is obtained from the stored graph shown in FIG. 6, a total purge rate $T_{PRG}$ (duty %), depending on the multiplier above, through the following equation;

$$T_{PRG}=Pmap\times A_{PRG}.$$

The purge control valve 48 is opened or closed by the aforesaid control means 50 to adjust a purge rate to this total purge rate $T_{PRG}$.

Also, when an air conditioner has been turned ON (case 3), a total purge rage $T_{PRG}$ (duty %) is computed, depending on a correction multiplier $C_{PRG}$ preset (stored) for ON operation of the air conditioner, through the following equation;

$$T_{PRG}=Pmap\times C_{PRG}.$$

The purge control valve 48 is opened or closed by the aforesaid control means 50 to adjust a purge rate to the total purge rate.

When idling has been started (case 4), a total purge rate, $T_{PRG}$ (duty %) is computed, depending on a correction multiplier $I_{PRG}1$ preset (stored) for ON operation of an idle switch not shown, through the following equation;

$$T_{PRG}=Pmap\times I_{PRG}1$$

or, a total purge rate $T_{PRG}$ is computed, depending on a preset (stored) correction value $I_{PRG}2$, through the following equation;

$$T_{PRG}=Pmap\times I_{PRG}2.$$

The purge control valve 48 is opened or closed by the aforesaid control section 50 to adjust a purge rate to the total purge rate $T_{PRG}$.

If any one of the items 1 to 4 above is satisfied, the total purge rate $T_{PRG}$ from the canister 46 can be increased by the control means 50 to fully purge hydrocarbons (HC) absorbed in the canister 46, which prevents performance of the canister from dropping without fail and is advantageous for service operation. In addition, release of hydrocarbons (HC) into the atmosphere from the canister 46 is prevented because inadequate purge is eliminated. Furthermore durability of the canister is improved and is advantageous from an economical point of view.

Also, because it is possible to prevent performance of the aforesaid canister 46 from dropping new types of fuel evaporation control based on new restrictions can be treated, which is very convenient in practical operation.

Figure 7:
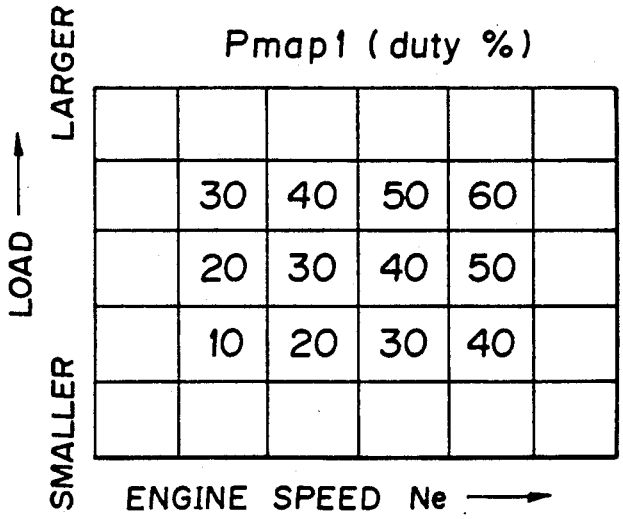
FIG. 7 is a diagram of a base map comprising engine speed versus a load which shows a second embodiment of the present invention.

FIG. 7 and FIG. 8 show a second embodiment of the present invention. In the following description, the same reference characters are assigned to like components performing like functions as the corresponding components in the first embodiment described above.

A feature of this second embodiment is that the control means 50 switches the base map Pmap 1, FIG. 7, to a correction map Pmap 2, FIG. 8, to change a duty percent when any of the conditions indicating an increase of evaporating fuel is satisfied and control is provided according to this changed duty percent to increase a rate of purging evaporating fuel.

Namely, for the following conditions;

1. T1<F1
2. T2<F2
3. T3<F3

T1: Preset value (°C.) for temperature of gas in a fuel tank

T2: Preset value (°C.) for temperature of a tank wall

T3: Preset value (°C.) for temperature of intake air

F1: Temperature (°C.) of gas in a tank wall

F2: Temperature (°C.) of a tank wall

F3: Temperature (°C.) of intake air

4. When an air conditioner is turned. If any of these items 1 to 4 is satisfied, or when all items are satisfied, control means 50 switches from the stored base map Pmap 1, FIG. 7, to the stored correction map Pmap 2, FIG. 8.

Because of the configuration of the second embodiment as described above, when any of these items 1 to 4 is satisfied, or when all of the items 1 to 4 are satisfied, a total purge rate $T_{PRG}$ from the canister 46 can be increased by the control means by switching the base map Pmap 1 to the correction map Pmap 2, so that, as in the first embodiment described above, hydrocarbons (HC) absorbed in the canister can fully be purged to prevent performance of the canister from dropping without fail, which is advantageous for practical operation. In addition, it is possible to prevent hydrocarbons (HC) from being released from the canister to atmosphere because inadequate purge is eliminated. Also, durability of the canister is improved and is advantageous when viewed from an economical point of view.

It should be noted that the present invention is not limited to the first and second embodiments described above, and that various applications and modifications are possible.

Although the above description of the first embodiment of the present invention assumes a case where, if any of the items 1 to 4 is satisfied, a control specific to the item is provided, it is possible to carry out the present invention in a mode where, for instance, the items 1 to 3 are combined to one item and a total purge rate $T_{PRG}$ is computed through the first equation;

$$T_{PRG}=Pmap\times P_{PRG}\times C_{PRG}$$

or through the second equation;

$$T_{PRG}=Pmap\times A_{PRG}\times C_{PRG}$$

Also in the second embodiment of the present invention, although the correction map Pmap 2 was formed depending on a value obtained by adding a value a to a duty percent in the base map Pmap 1, it is possible to form a base map depending on a value obtained by multiplying a duty percent in a base map by a certain value, or a value obtained using a numerical value which increases or decreases in association with an engine speed or a load, or in other ways.

As described above in detail, in the evaporating fuel control device for vehicles according to the present invention, control means 50 controls a rate of purging of evaporating fuel by opening or closing a purge control valve 48 arranged in an air path between a canister and an intake air path according to a duty percent from a base map. The control means functions to correct and control a duty percent from a base map to increase a rate of purging evaporating fuel from a canister in response to a detection signal from detecting means 58 indicating any or all of the conditions for increase of evaporating fuel. Thus, when any or all of the conditions for an increase of evaporating fuel is (are) detected, hydrocarbons (HC) absorbed in a canister can fully be purged to prevent performance of the canister from dropping without fail by correcting and controlling a duty percent from a base map for increasing a rate of purging evaporating fuel from the canister. This is advantageous for practical operation, and also to eliminate inadequate purge so that release of hydrocarbons (HC) from the canister to atmosphere can be prevented and also durability of the canister can be improved.

Although a particular preferred embodiment of the invention has been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. In an evaporating fuel control device for a vehicle having a canister arranged in line with an air path communicating a fuel tank to an intake air path of a combustion engine wherein evaporated fuel generated in the fuel tank is absorbed and stored in the canister when the combustion engine is shut off, and wherein the absorbed and stored fuel is purged and fed to the intake air path by introducing new air into the air path when the combustion engine is running, the evaporating fuel control device also having a control mean for controlling a purge rate of the evaporated fuel by varying a purge control valve means arranged in line with the air path between the canister and the intake air path according to a duty percent value from a base map, the improvement comprising:

a temperature sensing means for detecting a temperature of a fuel tank wall as an indication of an amount of the evaporated fuel inside the fuel tank; and said control means including means for correcting and controlling the duty percent value in response to a signal from said temperature sensing means so that the purge rate of the evaporated fuel is increased when said signal from said temperature sensing means indicates that the amount of evaporated fuel has increased.

2. The device of claim 1, wherein said control means corrects and controls the duty percent value by using a multiplier associated with a temperature change of the fuel tank wall.

* * * * *